United States Patent [19]

Whittenberger

[11] Patent Number: 4,850,945

[45] Date of Patent: Jul. 25, 1989

[54] GATEFOLD APPARATUS

[75] Inventor: John S. Whittenberger, Sidney, Ohio

[73] Assignee: Baumfolder Corporation, Sidney, Ohio

[21] Appl. No.: 177,509

[22] Filed: Apr. 4, 1988

[51] Int. Cl.[4] ..... B31B 1/00

[52] U.S. Cl. ..... 493/14; 493/420; 493/421

[58] Field of Search ..... 493/419, 420, 421, 460, 493/461, 249, 444

[56] References Cited

U.S. PATENT DOCUMENTS

| | | | |
|---|---|---|---|
| 2,997,295 | 8/1961 | Beck | 493/420 |
| 3,901,501 | 8/1975 | Kistner | 493/444 |
| 4,419,088 | 12/1983 | Nemec | 493/444 |

FOREIGN PATENT DOCUMENTS

| | | | |
|---|---|---|---|
| 1214247 | 4/1966 | Fed. Rep. of Germany | 493/421 |
| 2034460 | 1/1972 | Fed. Rep. of Germany | 493/421 |
| 2417750 | 10/1975 | Fed. Rep. of Germany | 493/421 |

*Primary Examiner*—Frederick R. Schmidt
*Assistant Examiner*—Robert Showalter

[57] ABSTRACT

Apparatus for making a gatefold in a central portion of a sheet along a gatefold line where the sheet has first and second outer leaves folded inwardly toward the central portion along first and second parallel fold lines, respectively, include a fold pan for receiving the sheet with the first outer leaf folded. The fold pan has upper and lower plate elements and a stop member therebetween. First and second rolls are positioned to engage the sheet upon movement of the central portion and the first outer leaf of the sheet into the fold pan, thereby folding the second outer leaf of the sheet inwardly toward the central portion at the second parallel fold line as the sheet passes between the second roll and a third roll. A gatefold pan receives the sheet from between the second and third rolls with the second outer leaf folded. The gatefold pan includes upper and lower plate elements and a stop member therebetween. The gatefold pan further includes a deflector which is movable from a retracted position, adjacent to the upper plate element, to an extended position. The deflector deflects the first outer leaf toward the central portion of the sheet. An actuator means moves the deflector between the retracted position and the extended position. The apparatus further includes a third roll positioned to engage the sheet upon movement of the central portion and the second outer leaf of the sheet into the gatefold pan, thereby folding the central portion of the sheet at the gatefold line as the sheet passes between the third and fourth rolls. A sensor means senses when the sheet begins movement out of the fold pan and senses when the sheet begins movement out of the gatefold pan. A control means, responsive to the sensor means, controls the actuator means such that the first leaf is guided between the third and fourth rolls and a gatefold of the sheet is produced.

13 Claims, 8 Drawing Sheets

86
88
90
P4
33 V
C1
RV2
BRI
24 VAC
T1
130
RV1
POWER
SI
1.5 A
MDL
115 VOLTS
WH
GR
U2
LM338
100
102
104
96
U1
LM340
12 VOLT
IN
OUT
92
98
94
J1
J2
J4
C16
35 V
22
C17
.01
C5
20 V
20
C6
R11
10 K
R2
3.3 K
R12
10 K
R13
2.2 K
R3
2.2 K
Q3
106
D1
R1
120
R4
2.2 K
LED1
FU2
4 A
ACC
J3
P3
J7
P7
J8
P8
SOL 1
68
SOL2
70
MR854
D2
MTM5N40
Q4
107
R17
470
IN6303A
D2
108
B
A

GATEFOLD APPARATUS

The present invention relates to apparatus for making a gatefold in a central portion of a sheet and, more particularly, to such apparatus which includes a gatefold pan assembly having a deflector and a sensor for controlling retraction of the deflector as the sheet begins to leave the pan.

A gatefolded sheet is one which has been folded three times so as to contain four leaves. The two outer leaves are folded inward initially along two parallel fold lines, and the resulting folded sheet is again folded along its centerline. The center fold, known as a gatefold, presents certain problems in automatic folding operations, particularly in view of the two previously folded, inwardly extending end leaves.

Because of these problems, various specially designed devices have been used to perform the gatefold operation. One such device, disclosed in U.S. Pat. No. 4,419,088, issued Dec. 6, 1983, to Nemec, utilizes a vertically movable gate assembly which includes a blade. When the blade is lowered, it drives the folded sheet down into the nip between two rolls to form the gatefold. A limit switch with a sensing arm detects the position of the sheet and activates the folding mechanism. Another specially designed gatefold device is shown in U.S. Pat. No. 3,901,501, issued Aug. 26, 1975, to Kistner. The Kistner device, like that disclosed in Nemec, includes a blade which is lowered to drive a sheet into the nip between two rolls to form the gatefold. The Kistner device further includes guiding tongues to either side of the blade which move downward with the blade and insure that the ends of the outer leaves also are pressed into the nip between the two rolls.

Such specially designed, stand alone equipment for performing a gatefold operation has the disadvantage that it is relatively inflexible in use and, in some instances, may not be conveniently mated to the folding equipment which performs the balance of the folding operations. One approach to dealing with these problems has been perform the gatefold operation in a conventional buckle folding machine. A buckle folding machine incluedes a series of rolls and fold pans. A sheet of paper to be folded is inserted between two rotating rolls of a first roll set and is driven by these two rolls into a fold pan of a fold pan assembly. A forward edge of the sheet eventually strikes a paper stop in the fold pan; however, the two rolls continue to feed the sheet forward. Thus, the sheet buckles and the bulge of this buckle eventually extends between two rolls of a second rool set. These rolls fold the sheet at the bulge and feet this folded edge into a second fold pan assembly. Upon striking a second paper stop there is a new buckle in the sheet and this buckle is, in turn, inserted between two rolls of a third roll set. This process continues until the sheet is folded a desired number of times.

When it is desired to perform a gatefold operation, a special gatefold pan assembly is substituted for one of the fold pan assemblies of the buckle folding machine. The gatefold pan assembly includes a movable deflector which is moved into position adjacent the roll set associated with the gatefold pan assembly at the proper time to insure that the ends of the outer leaves are also inserted into the nip between these rolls along with the bulge in the central portion of the sheet at the gatefold line.

In the past, the timing for actuation and deactuation of the deflector has been determined by a sensor positioned on the fold pan which precedes the gatefold pan assembly in the sheet path through the folding machine. Actuation occurred as the sheet left the fold pan and deactuation was effected a fixed time thereafter. Problems have occurred with this arrangement when the speed of operation of the machine has fluctuated. Additionally, the fixed time for deactuation varies as sheet sizes are changed, thus requiring that the operator of the folding machine adjust this time period at the beginning of each folding job. This has been time consuming since it has typically been accomplished empirically. It is seen, therefore, that a need exists for apparatus for performing a gatefold operation which is not subject to these problems.

SUMMARY OF THE INVENTION

These needs are met by apparatus according to the present invention for making a gatefold in a central portion of a sheet along a gatefold line. The sheet has first and second outer leaves folded inwardly toward the central portion along first and second parallel fold lines, respectively. The apparatus comprises a fold pan for receiving the sheet with the first outer leaf folded. The fold pan includes upper and lower plate elements and a stop member therebetween. First and second rolls engages the sheet and the central portion and the first outer leaf of the sheet into the fold pan. The apparatus further includes a third roll positioned to engage the sheet upon movement of the sheet into the fold pan, thereby folding the second outer leaf of the sheet inwardly toward the central portion at the second parallel fold line as the sheet passes between the second an third rolls. A gatefold pan receives the sheet from between the second and third rolls with the second outer leaf folded. The gatefold pan includes upper an lower plate elements and a stop member therebetween. The gatefold pan further includes a deflector which is movable from a retracted position, adjacent to the upper plate element, to an extended position. The deflector deflects the first outer leaf toward the central portion of the sheet. An actuator means moves the deflector between the retracted position and the extended position. The apparatus further includes a fourth roll positioned to engage the sheet upon movement of the central portion and the second outer leaf of the sheef into the gatefold pan, thereby folding the central portion of the sheet at the gatefold line as the sheet passes between the third and fourth rolls. A sensor means senses when the sheet begins movement out of the fold pan and senses when the sheet begins movement out of the gatefold pan. A control means, responsive to the sensor means, controls the actuator means such that the first leaf is quided between the third and fourth rolls an a gatefold of the sheet is produced. Movement of the deflector to its retracted position occurs when a sheet is sensed moving out of the fold pan and is not sensed moving out of the gatefold pan within a predetermined time, or when two successive sheets are sensed as moving out of the fold pan without an intervening sensing of a sheet moving out of the gatefold pan. As a consequence jams may be cleared and operation of the apparatus simplified.

The deflector defines a curved face surface which is positioned adjacent the third roll when the deflector is in the extended position. The deflector comprises an elongated bar which extends substantially the entire width of the gatefold pan. The actuator means for moving the defelector between the retracted position an the extended position includes solenoid means mounted on the gatefold pan, and linkage means extending between the solenoid means and the deflector. The solenoid means comprises a pair of solenoids, an the linkage means comprises a transverse element connected to the pair of solenoids, and a pair of linkage rods extending from opposite ends of the transverse element to opposite ends of the deflector.

The sensor means comprises a first sensor mounted on the fold pan adjacent the associated stop member so as to detect when a sheet is inserted into the fold pan, and a second sensor mounted on the gatefold pan adjacent the associated stop member so as to detect when a sheet is fully inserted into the gatefold pan. The first and second sensors are photo-optical detectors.

The control means effects actuation of the actuator means in response to the first sensor indicating movement of the sheet out of the fold pan, so as to move the deflector from the retracted position to the extended position. The control means effects deactuation of the actuator means in response to the second sensor indicating movement of the sheet out of the gatefold pan, so as to move the deflector from the extended position to the retracted position.

The actuator means includes solenoid means mounted on the gatefold pan, linkage means extending between the solenoid means and the deflector, and spring means for returning the deflector from the extended position to the retracted position when the solenoid means is deactuated. The actuator means includes at least one electrical solenoid, and in which the control means includes means for reducing the electrical power applied thereto after actuation of the solenoid for a preset period of time.

Accordingly, it is an object of the present invention to provide apparatus for making a gatefold in a central portion of a sheet along a gatefold line in which a sensor arrangement senses when the sheet begins movement out of a fold pan and when the sheet begins movement out of a gatefold pan; to provide a gatefold pan assembly for such apparatus which includes a sensor mounted on the gatefold pan adjacent the associated stop member so as to detect when a sheet is inserted into the gatefold pan; to provide such apparatus in which a control circuit is responsive to the sensor arrangement; and to provide such apparatus in which detection of jams results in movement of a gatefold detector into a retracted position to facilitate clearing the jam.

Other objects and advantages of the invention will be apparent from the following description, the accompanying drawings and the appended claims.

DETAILED DESCRIPTION OF THE PREFERRED EMBODIMENT

Figure 1:
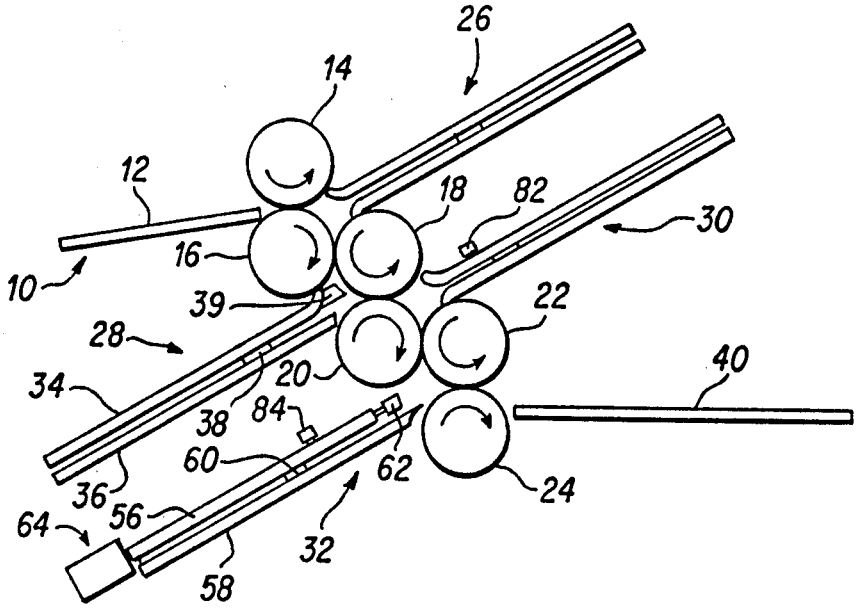
FIG. 1 is a diagrammatic side view of a buckle folding machine which incorporates a gatefold pan assembly constructed according to the present invention.

Reference is made to FIGS. 1 and 2A through 2D which illustrate the gatefold operation of the apparatus of the present invention. The apparatus includes a buckle folding machine which has an input conveyor 10, rolls 14, 16, 18, 20, 22, and 24, and fold pans 26, 28, and 30, and gatefold pan 32. Each fold pan, as for example pan 28, comprises an upper plate element 34 and a lower plate element 36, and a stop member 38 therebetween. A conveyor 40 is provided at the output of the folding machine to move the folded sheets to other equipment for post-folding processing.

There are several buckle folder machine configurations which can be used to perform a gatefold operation. One configuration employs two folding sections. The first folding section performs two folds; the first is folding of the first outer leaf inwardly toward the central portion, and the second is folding the second outer leaf inwardly toward the central portion. The folded sheet is then delivered to the second folding section where the gatefold pan has been installed in the No. 1 fold position (occupied by fold pan 26 in FIG. 1).

The second confirguration employs a single folding section. The gatefold pan is installed in the No. 3 fold position (occupied by fold pan 30 in FIG. 1) Finally, the third configuration, shown in FIG. 1, is one in which the gatefold pan 32 is installed in the No. 4 fold position. Other configurations are also possible.

For the present purposes, the gatefold operation will be explained with the gatefold pan in the No. 4 position of a single buckle folding section. The gatefold folding process is very similar in the other machine configurations, and it will be appreciated that the present invention is equally applicable to these configurations as well.

Figure 2A:
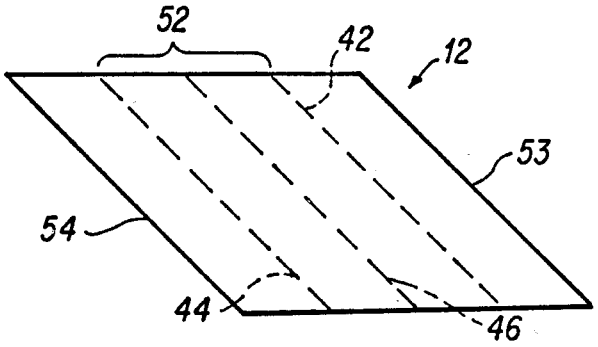
FIGS. 2A through 2D are perspective views of a sheet, illustrating a series of folding operations.
Figure 2C:
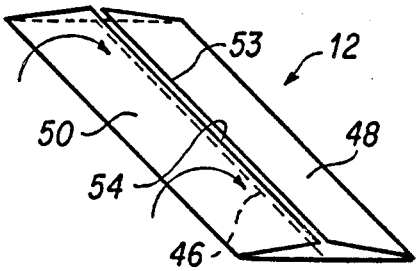
Figure 2B:
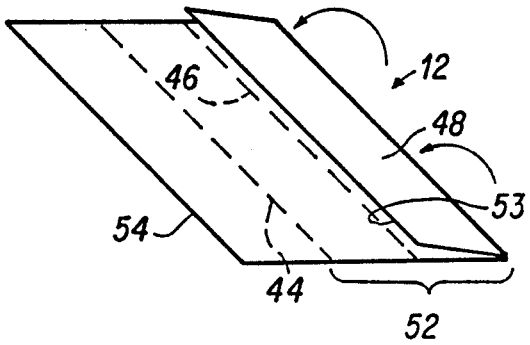

In a typical gatefold operation, an unfolded sheet illustrated in FIG. 2A, is conveyed to and captured by rolls 14 and 16, and enters fold pan 26. The sheet 12 stops at the stop member 38, and due to the continuing rotation of rolls 16 and 14, the sheet 12 buckles. The buckled portion of sheet 12 is caught between rolls 16 and 18, thereby forming a fold along the first fold line 42, as illustrated in FIG. 2B. Fold pan 28 has a deflector 39 installed which causes the folded sheet 12 to pass to rolls 18 and 20, causing the sheet to enter fold pan 30, folded as illustrated in FIG. 2B. The leading edge of the folded sheet, at fold line 42, strikes the stop member 38 in fold pan 30. Due to the continued rotation of the rolls 18 and 20, the sheet is caused to buckle. The buckled portion of sheet 12 is caught between rolls 20 and 22; thereby forming a fold along the second fold line 44, as illustrated in FIG. 2C.

Figure 2D:
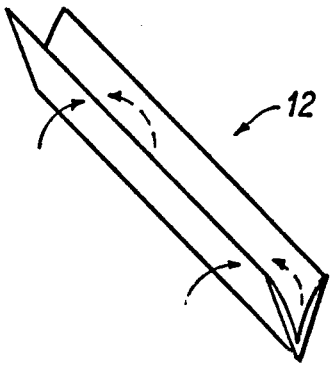

Next the sheet 12 is to be folded along a gatefold line 46, as shown in FIG. 2D. Prior to this gatefolding operation, the sheet 12 has first and second outer leaves 48 and 50 which have been folded inwardly toward a central portion 52 of the sheet along the first and second parallel fold lines 42 and 44, respectively. In the gatefolding operation, care must be taken to insure that the sheet remains folded at fold lines 42 and 44 so as to produce a gatefolded sheet as depicted in FIG. 2D. The gatefolding operation is accomplished by buckle folding, as described above. The sheet 12, having two folds, is driven by rolls 20 and 22 into gatefold pan 32 until the leading edge of the folded sheet along fold line 44 strikes the stop member in pan 32. Due to the continued rotation of the rolls 20 and 22, the sheet is caused to buckle. The bucled portion of the sheet 12 is caught between rolls 22 and 24, thereby forming a fold along the gatefold line 46, as shown in FIG. 2D.

It is important that the outer edges 53 and 54 of leaves 48 and 50, respectively, be directed to the nip between rolls 22 and 24 so that the gatefold operation can be accomplished in the desired fashion. It has been found that the greatest difficulty in this regard occurs as edge 53 passes between rolls 20 and 22. Edge 53 has a tendency not to travel around the periphery of roll 22 and into the nip between rolls 22 and 24. Rather, it may travel toward gatefold pan 32, with the result that the sheet 12 unfolds at fold line 42 and the gatefolding operation is not successfully accomplished.

In order to avoid this problem, the gatefold pan 32 of the present invention includes upper and lower plate elements 56 and 58, respectively, and a stop member 60 therebetween. As described more fully below, a deflector 62 is movable from a retracted position, adjacent to the upper plate element 56, shown in FIG. 4A, to an extended position, shown in FIGS. 4B and 4C. When in the extended position, deflector 62 deflects the first outer leaf 48 toward the central portion 52 of the sheet 12. The gatefold pan 32 further includes an actuator means 64 for moving the deflector 62 between the retracted position and the extended position.

Figure 3:
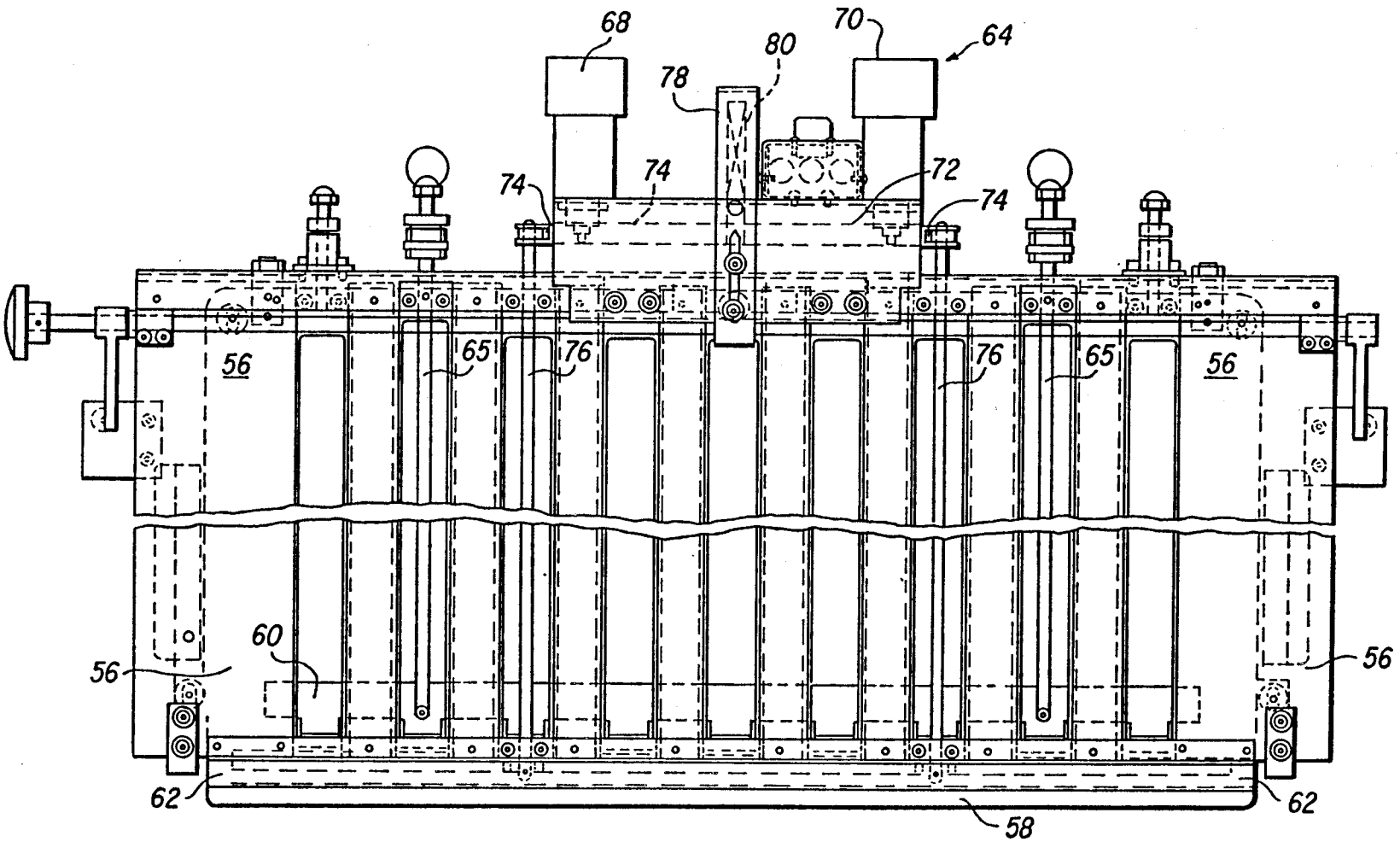
FIG. 3 is a plan view of a gatefold pan according to the present invention with a central portion broken away.
Figure 4A:
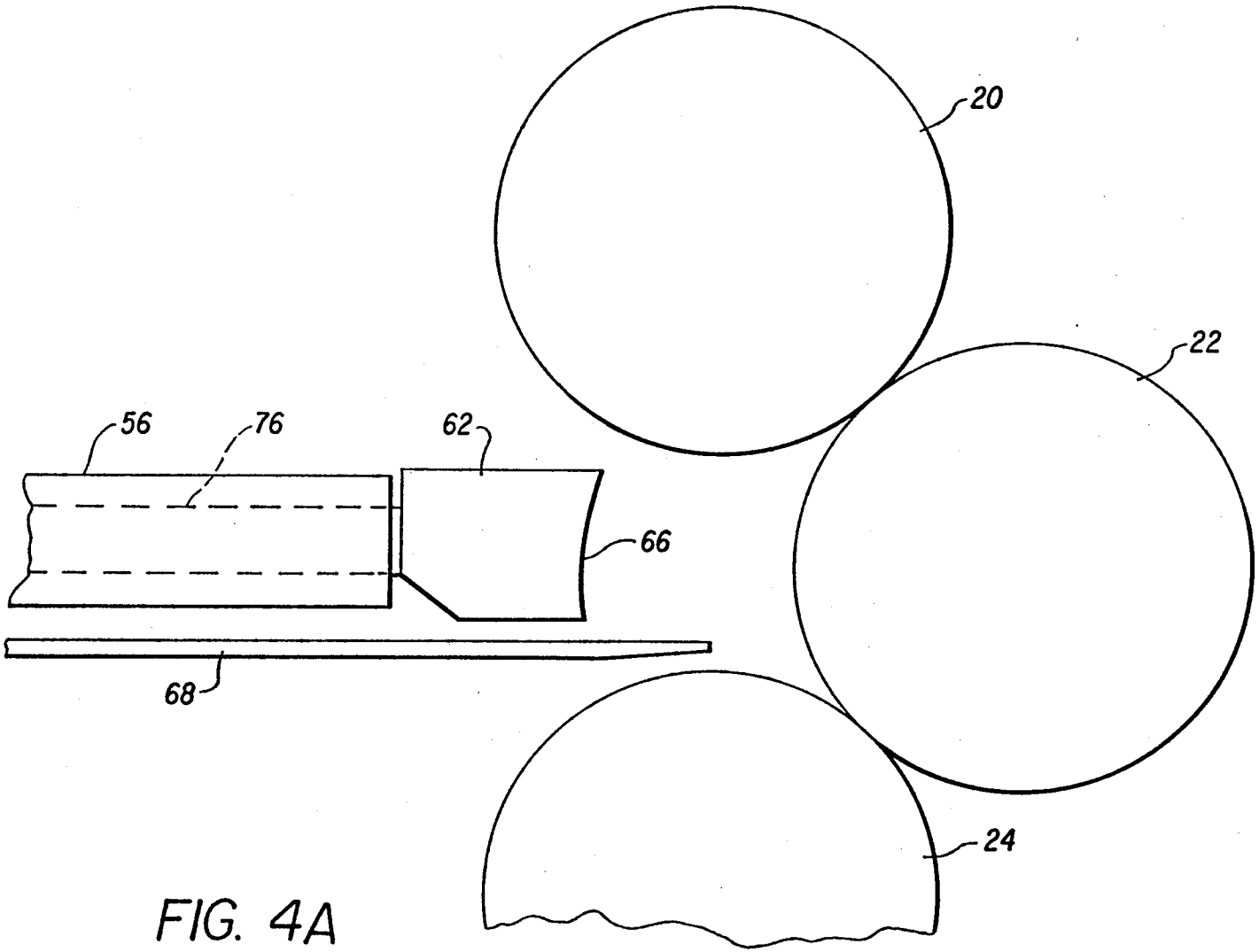
FIG. 4A is an enlarged side view of the gate fold pan and associated rolls, with the deflector in its retracted position.
Figure 4B:
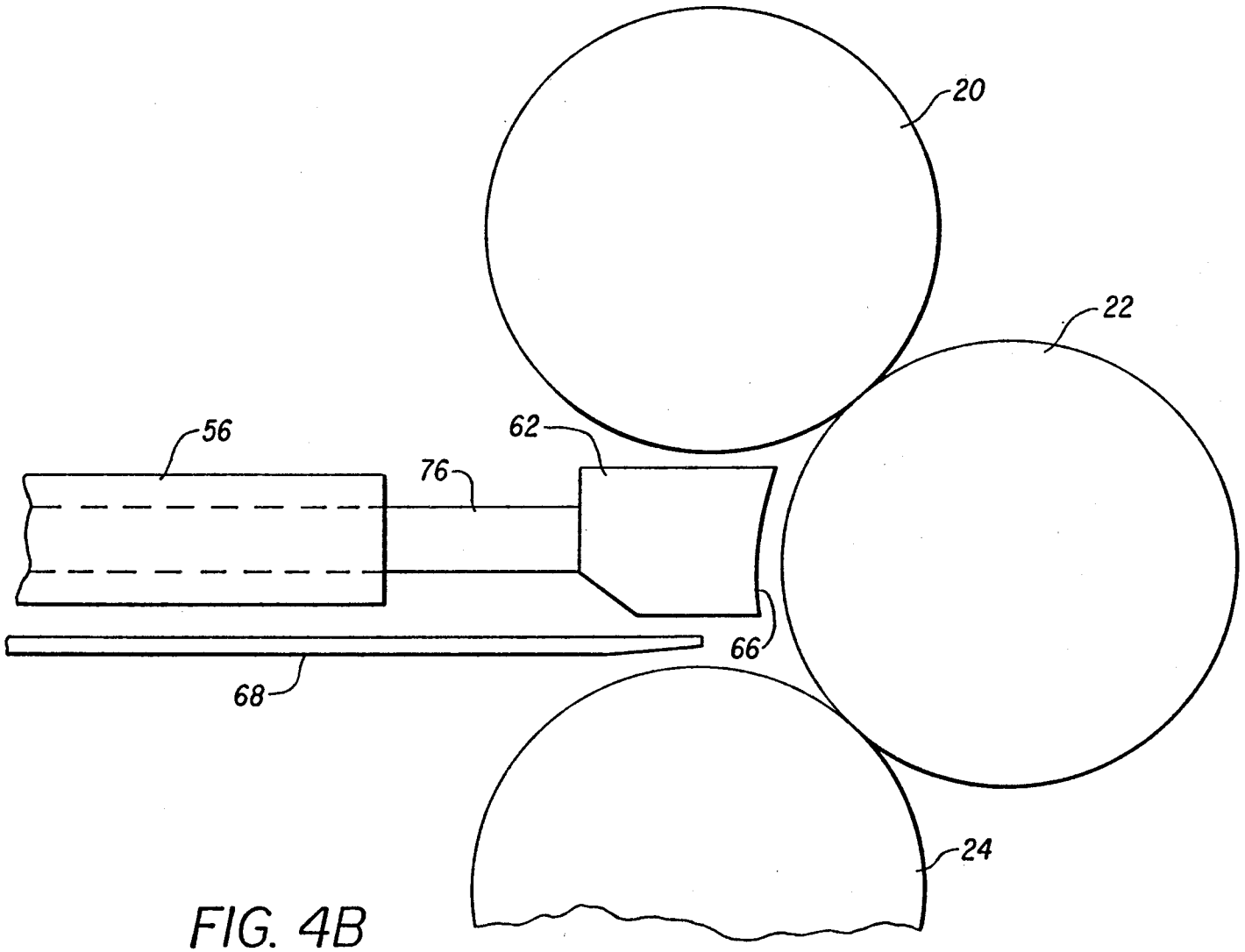
FIG. 4B is a view similar to FIG. 4A with the deflector in its extended position.

Reference is made to FIGS. 3, and 4A and 4B, which illustrate the gatefold pan 32 and its operation in greater detail. In a number of respects, the gatefold pan 32 is similar in construction to the fold pans 26, 28, and 30. Shafts 65, for example, permit adjustment of the position of the stop member 60.

Figure 4C:
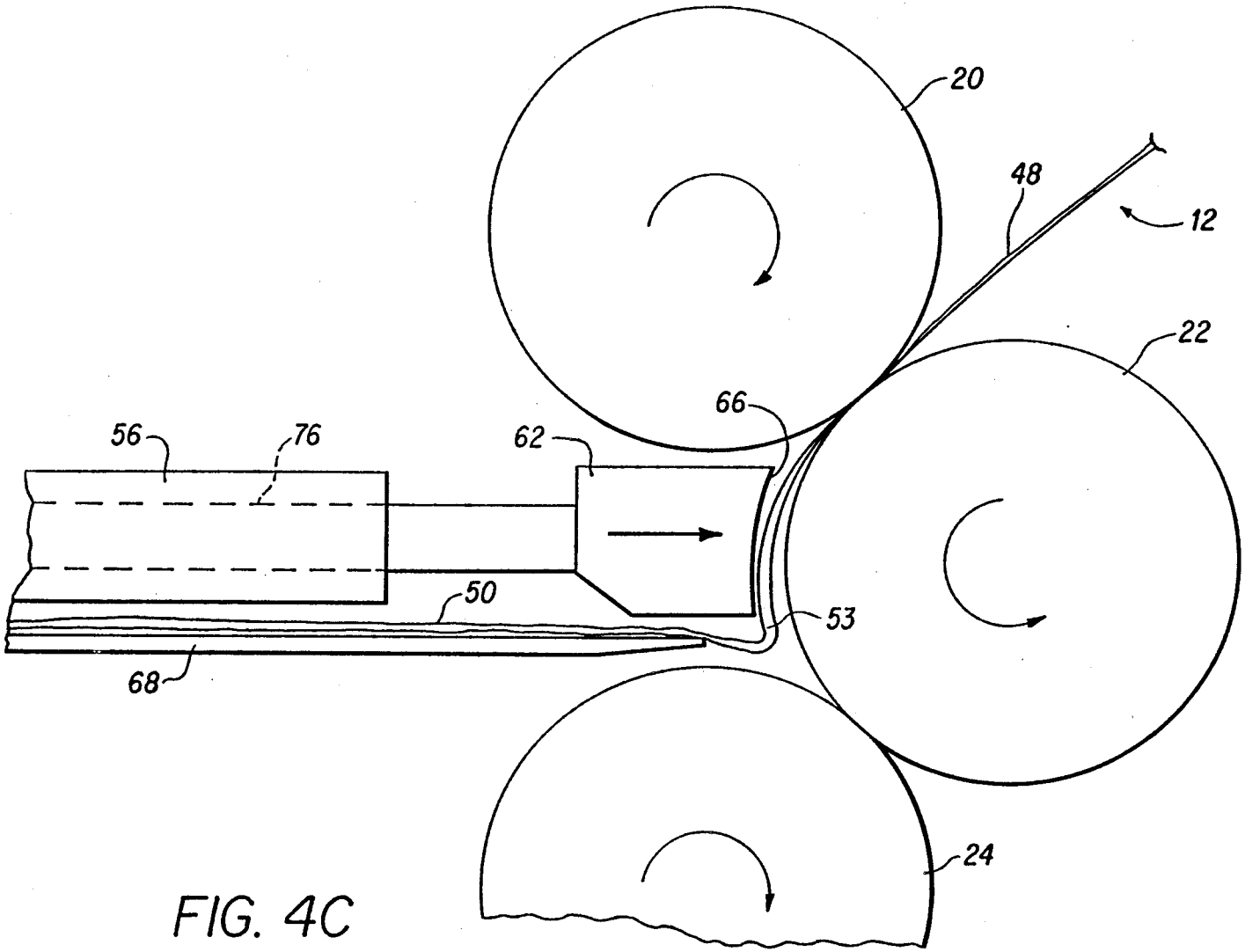
FIG. 4C is a view similar to FIG. 4B, illustrating the gatefold operation.

The gatefold pan 32 includes a number of other features, however, which permit the gatefold function to be effected. The deflector 62 is, for example, is a specially designed, elongated bar which extends across substantially the entire width of the pan 32. As seen in FIG. 4C, the deflector 62 defines a curved face surface 66 which is positioned adjacent the roll 22 when the deflector 62 is in the extended position. The actuator means 64 for moving the deflector 62 between the retracted position and the extended position includes a solenoid means, comprising solenoids 68 and 70 which are mounted on the pan 32 by means of bracket 72. A linkage meas, including transverse element 74 and linkage rods 76, extends between the solenoids 68 and 70 and the deflector 62. The transverse element 74, connected to the pair of solenoids 68 and 70, is attached at its opposite ends to the pair of linkage rods 76 which are also attached to opposite ends of the deflector 62. Forming a part of the bracket 72 is element 78. A spring 80 extends between one end of the element 78 and the transverse element 74 so as to spring bias the deflector 62 toward its retracted position. When solenoids 68 and 70 are actuated, the deflector 62 is moved into its extended position.

As is best seen in FIG. 4C, the deflector 62, when in its extended position, insures that the leaf 48 will not unfold as it passes between rolls 20 and 22. Instead, the curved surface 66 of the deflector 62 directs the edge 53 of leaf 48 toward the nip between rolls 22 and 24.

Figure 5A:
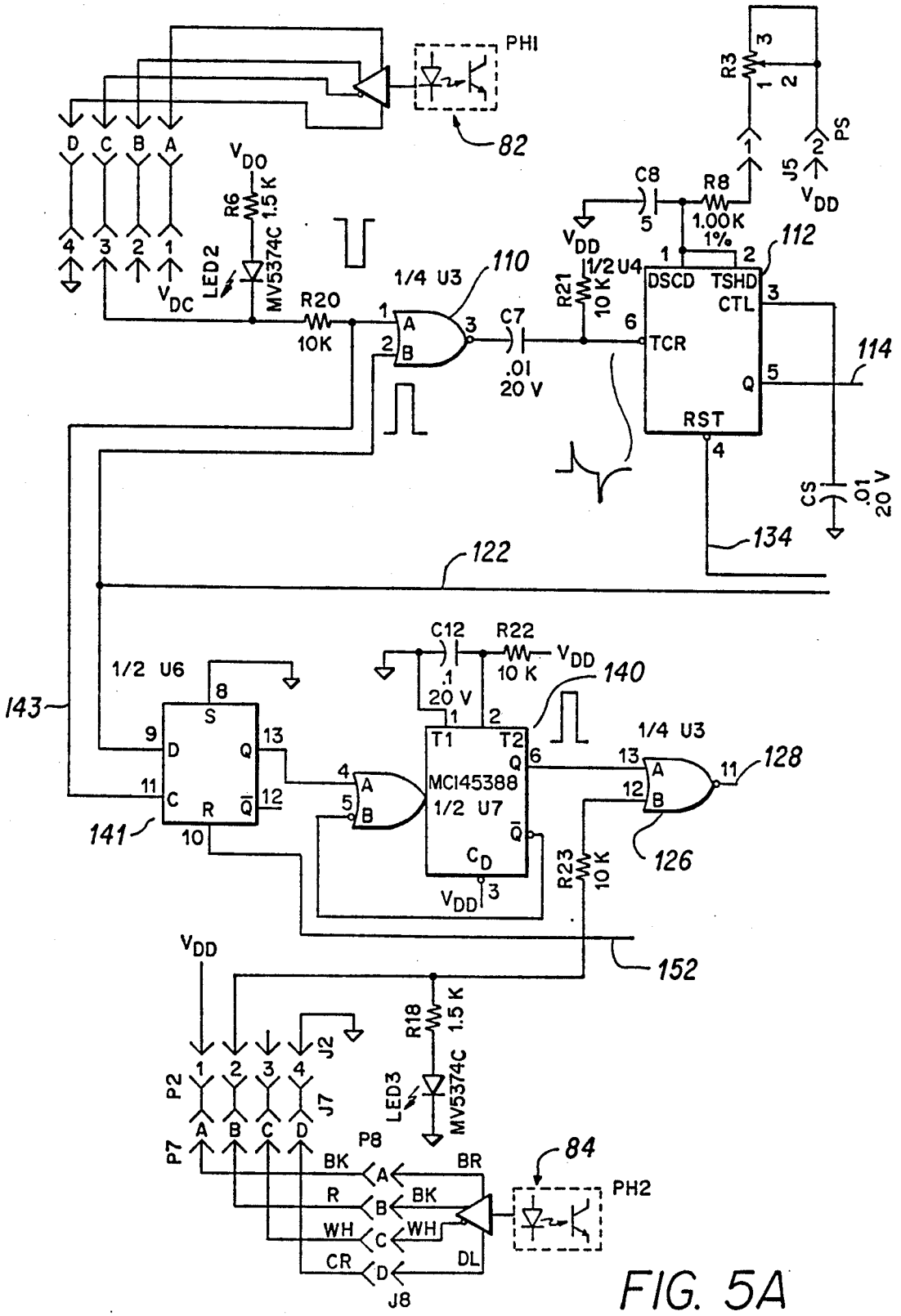
FIGS. 5A and 5B, when assembled with FIG. 5A to the left of FIG. 5B, illustrate a portion of the control circuity of the apparatus of the present invention.
Figure 5B:
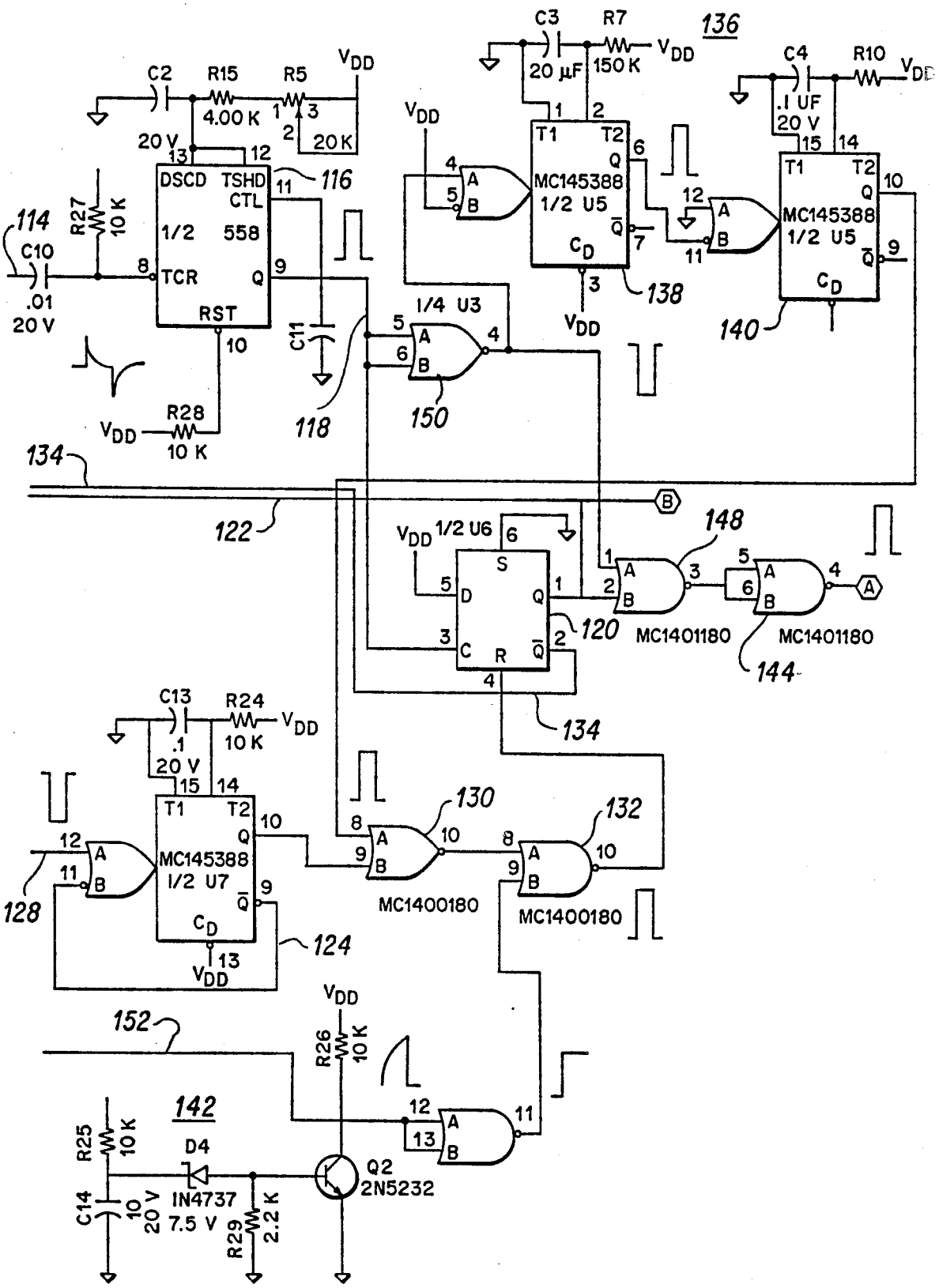
Figure 6:
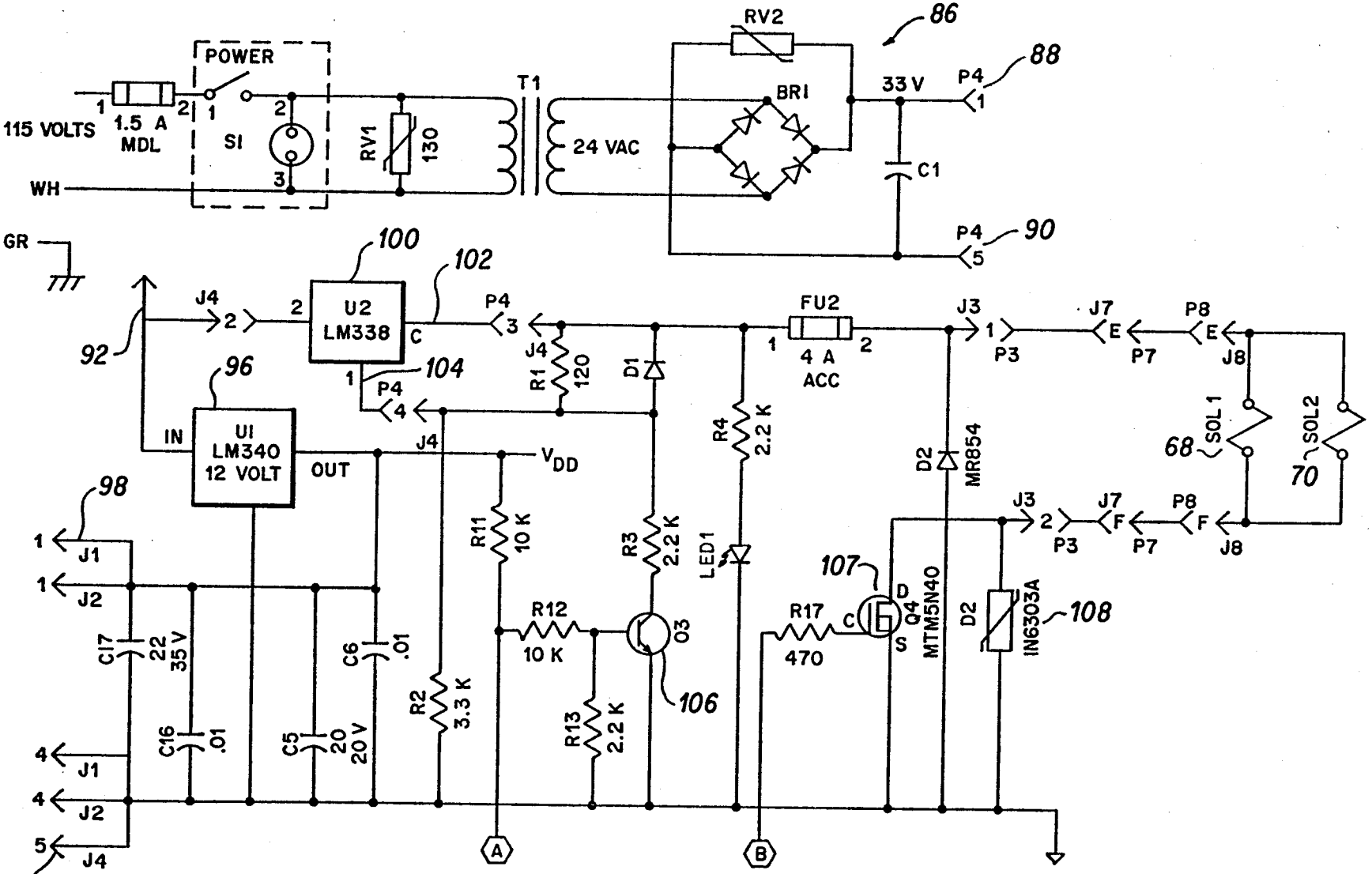
FIG. 6 illustrates the balance of the control circuitry of the apparatus of the present invention.

It will be appreciated that movement of the deflector between its extended an retacted positions must be accomplished in a precisely timed fashion. If the deflector is extended too soon in the gatefolding operation, the movement of the folded sheet 12 into pan 32 may be inhibited before the leading edge of the sheet contacts the stop 60, resulting in premature buckling and folding along other than the desired gatefold line. If the deflector 62 is extended too late in the gatefolding operation, the leaf 48 may not be deflected as desired. Similarly, it is important for the deflector to be retracted at the appropriate time. Too early a retraction may result in the leaf 48 not being maintained in its folded position. Too late a retraction, on the other hand, may interfere with folding of the following sheet. These problems are compound by fluctuations in operating speed and sheet size. In order to avoid these problems a sensor means, including sensor 82 and 84 (FIG. 1), is provided for sensing when a sheet 12 begins movement out of the fold pan 30 and for sensing when the sheet begins movement out of the gatefold pan 32. A control means, including the circuitry of FIGS. 5A, 5B and 6, is responsive to the sensor means for controlling the actuator means 64 such that the first leaf 48 is guided between the rolls 22 and 24 and a gatefold of the sheet 12 is produced. It will be appreciated that variations in sheet dimensions and fluctuations in the speed of operation of the folding equipment will automatically be taken into account in the timing for actuation and deactuation of the solenoids 68 and 70 by this arrangement.

As seen in FIG. 6, circuit 86 provides a source of 33–35 volt d.c. unregulated power at terminals 88 and 90. These terminals are connected to terminals 92 and 94, respectively, such that voltage regulator 96 may provide regulated 12 volt d.c. power to the integrated circuity of FIGS. 5A and 5B at terminals 94 and 98. The control means includes means for reducing the electrical power applied to the solenoids 68 and 70 after actuation of the solenoids for a preset period of time. Voltage regulator 100 provides an output signal on line 102 which is a function of the resistance to ground provided on line 104. When transistor 106 is switched OFF, the voltage on line 104 is approximately 35 volts d.c., the voltage required to actuate the solenoids 68 and 70. When transistor 106 is switched ON, however, the voltage on line 104 drops to approximately 15 volts d.c. the voltage need to maintain the solenoids 68 and 70 in their actuated states.

The signal on line 102 is typically maintained at 35 volts d.c. for approximately 60 msec., and then drops to 15 volts. The overall length of the signal is dependent on the speed of operation of the folding system. Power to the solenoids 68 and 70 is controlled by switching of FET 107. FET 107 is protected by surge suppressor 108. It will be appreciated that actuation of solenoids 68 and 70 is a function of a control signal supplied to terminal B, while the step down of the voltage level in the signal supplied to solenoids 68 and 70 is controlled by the signal applied to terminal A.

FIGS. 5A and 5B illustrate circuitry which provides the control signals to the terminals A and B of FIG. 6. The sensor 82 is mounted on the fold pan 30 adjacent the asociated stop member so as to detect when a sheet 12 is fully inserted into the fold pan. The sensor 84 is mounted on the gatefold pan 32 adjacent the associated stop member 60 so as to detect when a sheet is fully inserted into the gatefold pan 32. The sensors 82 and 84 are preferably photo-optical detectors. The control means effects actuation of the actuator means in response to the first sensor 82 indicating movement of the sheet out of the fold pan 30, so as to move the deflector 62 from the retracted position to the extended position. The control means effects deactuation of the actuator means in response to the second sensor 84 indicating movement of the sheet out of the gatefold pan 32, so as to move the deflector 62 from the extended position to the retracted position.

A negative pulse is provided to NOR gate 110 by the sensor 82 with the trailing positive-going edge of the pulse coinciding with the movement of the sheet 12 away from the stop member of the pan 30. A delay is provided by timer circuit 112 in a pulse output on line 114. Timer circuit 116 provides a pulse on line 118, in response to an input on line 114, which actuates flip-flop 120, causing the B terminal output on line 122 to go HIGH. When sensor 84 detects the movement of sheet 12 out of gatefold pan 32, a pulse is supplied to one-shot circuit 124 via NOR gate 126 over line 128. One-shot circuit 124 then supplies a pulse through NOR gate 130 and NAND gate 132 to reset flip-flop 120 and terminate the control signal to terminal B. This also resets circuit 112 via line 134.

In a first abnormal situation circuit 136, including one-shots 138 and 140, provides a reset pulse to gate 130 after approximately 2.5 seconds in the event that the actuation of the deflector 62 is not earlier terminated. This may happen when a paper jam occurs. Flip-flop 141 is responsive to a second pulse from the sensor 82 on line 143 while line 122 is HIGH, indicating continued actuation of the deflector. In this second abnormal situation, which may also occur during a paper jam, a HIGH output to one-shot circuit 140 results in resetting flip-flop 120 via gates 126, 130, and 132, and one-shot circuit 124. Circuit 142 is provided to initialize the flip-flops when power is applied to the circuitry.

The step-down in the power signal applied to the solenoids occurs when the output of gate 144 goes high. The input to gate 144 from flip-flop 120 is blocked by the signal on line 146, supplied to gate 148 by gate 150. The duration of this blockage of the output from the flip-flop 120 determines the period of time that 35 volts is applied to the solenoids, prior to a reduction to 15 volts. As is apparent, this duration is adjusted by means of potentiometer R5.

It will be appreciated that the present invention provides for a deactuation of the solenoids 68 and 70 in two situations other than the normal operating mode. First, the deflector 62 is returned to its retracted position when a signal from sensor 82 is not followed by a signal from sensor 84 within approximately 2.5 seconds. Second, the deflector 62 is returned to its retracted position when two successive signals are received from sensor 82 without an intervening signal from sensor 84. Either of these situations may occur at the time of a paper jam in the gatefold area. By causing the deflector to retract, it is withdrawn from the area adjacent rolls 20, 22 and 24, opening up this area and perhaps permitting the paper jam to pass out of the buckle folding machine without operator intervention. It will be appreciated that this will be highly advantageous. Additionally, the circuitry povides for an automatic reset, even in those instances where an operator is required to remove the paper jam manually.

Having described the invention in detail and by reference to the preferred embodiment thereof, it will be apparent that other modifications and variations are possible without departing from the scope of the invention defined in the appended claims.

What is claimed is:

1. Apparatus for making a gatefold in a central portion of a sheet along a gatefold line, said sheet having first and second outer leaves folded inwardly toward said central portion along first and second parallel fold lines, respectively, comprising:

a fold pan for receiving said sheet with the first outer leaf folded, said fold pan including upper and lower plate elements and a stop member therebetween, first and second rolls positioned to engage said sheet and effect movement of said central portion and said first outer leaf of said sheet into said fold pan, a third roll positioned for folding said second outer leaf of said sheet inwardly toward said central portion at said second parallel fold line as said sheet passes between said second and third rolls, a gatefold pan for receiving said sheet from between said second and third rolls with the second outer leaf folded, said gatefold pan including upper and lower plate elements and a stop member therebetween, a deflector movable from a retracted position, adjacent to said upper plate element, to an extended position in which said deflector deflects said first outer leaf toward said central portion of said sheet, and actuator means for moving said deflector between said retracted position and said extended position, a fourth roll positioned to engage said sheet upon movement of said central portion and said second outer leaf of said sheet into said gatefold pan, thereby folding said central portion of said sheet at said gatefold line as said sheet passes between said third and fourth rolls, sensor means for sensing when said sheet begins movement out of said fold pan and for sensing when said sheet begins movement out of said gatefold pan, and control means, responsive to said sensor means, for controlling said actuator means such that said first leaf is guided between said third and fourth rolls and a gatefold of said sheet is produced, said control means including means for providing for movement of said deflector to said retracted position when two successive sheets are sensed as leaving said fold pan without sensing a sheet leaving said gatefold pan in the interim, whereby a sheet jam may be eliminated.

2. The apparatus of claim 1 for making a gatefold in a central portion of a sheet along a gatefold line, in which said deflector defines a curved face surface which is positioned adjacent said third roll when said deflector is in said extended position.

3. The apparatus of claim 2 for making a gatefold in a central portion of as sheet along a gatefold line, in which said control means includes means for providing movement of said deflector to said retracted position when a time delay of a predetermined period occurs after sensing a sheet leaving the fold pan without sensing a sheet leaving the gatefold pan.

4. The apparatus of claim 1 for making a gatefold in a central portion of a sheet along a gatefold line, in which said actuator means for moving said deflector between said retracted position and said extended position includes solenoid means mounted on said gatefold pan, and linkage means extending between said solenoid means and said deflector.

5. The apparatus of claim 4 for making a gatefold in a central portion of a sheet along a gatefold line, in which said solenoid means comprises a pair of solenoids, and in which said linkage means comprises a transverse element connected to said pair of solenoids, and a pair of linkage rods extending from opposite ends of said transverse element to opposite ends of said deflector.

6. The apparatus of claim 1 for making a gatefold in a central portion of a sheet along a gatefold line, in which said sensor means comprises a first sensor mounted on said fold pan adjacent the associated stop member so as to detect when a sheet is fully inserted into said fold pan, and a second sensor mounted on said gatefold pan adjacent the associated stop member so as to detect when a sheet is fully inserted into said gatefold pan.

7. The apparatus of claim 6 for making a gatefold in a central portion of a sheet along a gatefold line, in which said first and second sensors are photo-optical detectors.

8. The apparatus of claim 6 for makin a gatefold in a central portion of a sheet along a gatefold line, in which said control means effects actuation of said actuator means in response to said first sensor indicating movement of said sheet out of said fold pan, so as to move said deflector from said retracted position to said extended position.

9. The apparatus of claim 8 for making a gatefold in a central portion of a sheet along a gatefold line, in which said control means effects deactuation of said actuator means in response to said second sensor indicating movement of said sheet out of said gatefold pan, so as to move said deflector from said extended position to said retracted position.

10. The apparatus of claim 9 for making a gatefold in a central portion of a sheet along a gatefold line, in which said acctuator means includes solenoid means mounted on said gatefold pan, linkage means extending between said solenoid means and said deflector, and spring means for returning said deflector from said extended position to said retracted position when said solenoid means is deactuated.

11. The appratus of claim 9 for making a gatefold in a central portion of a sheet along a gatefol line, in which said actuator means includes at least one electrical solenoid, and in which said control means includes means for reducing the electrical power applied thereto after actuation of said solenoid for a preset period of time.

12. The apparatus of claim 9 said control means effects deactuation of said actuator means in response to said second sensor failing to indicate movement of said sheet out of said gatefold pan within a predetermined period of time following an indication by said first sensor that a sheet thas moved out of said fold pan.

13. Apparatus for making a gatefold in a central portion of a sheet along a gatefold line, said sheet having first and second outer leaves folded inwardly toward said central portion along first and second parallel fold lines, respectively, comprising:

a fold pan for receiving said sheet with the first outer leaf folded, said fold pan including upper and lower plate elements and a stop member therebetween, first and second rolls positioned to engage said sheet and effect movement of said central poriton and said first outer leaf of said sheet into said fold pan, a third roll positioned for folding said second outer leaf of said sheet inwardly toward said central portion at said second parallel fold line as said sheet passes between said second and third rolls, a gatefold pan for receiving said sheet from between said second and third rolls with the second outer leaf folded, said gatefold pan including:

upper and lower plate elements and a stop member therebetween, a deflector movable from a retracted position, adjacent said upper plate element, to an extended position in which said deflector deflects said first outer leaf toward said central portion of said sheet, and, actuator means for moving said deflector between said retracted position and said extended position, a fourth roll positioned to engage said sheet upon movement of said central portion and said second outer leaf of said sheet into said gatefold pan, thereby folding said central portion of said sheet at said gatefold line as said sheet passes between said third and fourth rolls, sensor means for sensing when said sheet begins movement out of said fold pan and for sensing when said sheet begins movement out of said gatefold pan, and control means, responsive to said sensor means, for controlling said actuator means such that said first leaf is guided between said third and fourth rolls and a gatefold of said sheet is produced, said control means including means for providing movement of said deflector to said retracted position when a time delay of a predetermined period occurs after sensing a sheet leaving the fold pan without sensing a sheet leaving the gatefold pan.

* * * * *